US008661587B1

(12) United States Patent
Leach

(10) Patent No.: US 8,661,587 B1
(45) **Date of Patent: *Mar. 4, 2014**

(54) INFANT SUPPORT PILLOW

(76) Inventor: Jamie S. Leach, Ada, OK (US)

( * ) Notice: Subject to any disclaimer, the term of this patent is extended or adjusted under 35 U.S.C. 154(b) by 1109 days.

This patent is subject to a terminal disclaimer.

(21) Appl. No.: 11/743,729

(22) Filed: May 3, 2007

(51) Int. Cl.
*B68G 5/00* (2006.01)
*A47C 20/00* (2006.01)

(52) U.S. Cl.
USPC ..... 5/655; 5/630; 5/632; 5/652

(58) Field of Classification Search
USPC ..... 5/655, 630, 632, 636, 652, 646; 297/452.41
See application file for complete search history.

(56) References Cited

U.S. PATENT DOCUMENTS

| | | | |
|---|---|---|---|
| 395,043 | A | 12/1888 | Doremus |
| 416,970 | A | 12/1889 | Taylor |
| 726,164 | A | 4/1903 | Hogan et al. |
| 909,453 | A | 1/1909 | Pullman |
| 1,376,625 | A | 5/1921 | Johnston |
| 1,447,288 | A | 3/1923 | Emmerich |
| 1,577,586 | A | 3/1926 | Morehouse |
| 1,769,722 | A | 7/1930 | Sutton |
| 2,149,140 | A | 2/1939 | Gonzalez-Rincones |
| D124,296 | S | 12/1940 | Thompson |
| 2,279,867 | A | 4/1942 | Falk |
| 2,328,871 | A | 9/1943 | Woehler |
| 2,336,707 | A | 12/1943 | Thompson |
| 2,404,108 | A | 7/1946 | Stauffacher et al. |
| 2,404,505 | A | 7/1946 | Knecht |
| 2,429,350 | A | 10/1947 | Farrand |
| 2,451,007 | A | 10/1948 | White |
| 2,495,482 | A | 1/1950 | Rogatz |
| 2,502,486 | A | 4/1950 | Savrin |
| 2,544,896 | A | 3/1951 | Nidetch et al. |
| D162,858 | S | 4/1951 | McGlinchey |
| 2,626,407 | A | 1/1953 | Kurry |
| 2,652,183 | A | 9/1953 | Hlivka |
| 2,694,202 | A | 11/1954 | Macrides |
| 2,694,204 | A | 11/1954 | Cross |
| 2,741,412 | A | 4/1956 | Hinkle |

(Continued)

FOREIGN PATENT DOCUMENTS

| | | |
|---|---|---|
| JP | 20041949989 | 7/2004 |
| WO | PCT/US01/270768 A1 | 3/2002 |

OTHER PUBLICATIONS

U.S. Appl. No. 11/193,195, filed Aug. 1, 2005, Leach.
U.S. Appl. No. 11/216,361, filed Aug. 31, 2005, Leach.

(Continued)

*Primary Examiner* — Carlos Lugo
*Assistant Examiner* — Alyson M Merlino
(74) *Attorney, Agent, or Firm* — Mary M. Lee

(57) ABSTRACT

A generally C-shaped infant support pillow ideal for small, premature or disabled infants. The pillow comprises a center section with two curved arms. The arms may be the same length or one may be longer than the other. Preferably, the end of one arm is receivable in a recess formed in or near the end of the other arm, so that the pillow has an open and a closed position. The arms may have opposing, inwardly-extending bulges that divide the central well into a larger and a smaller secondary well. The inner perimeter of the center section may be elasticized to "hug" the infant. The pillow may include a strap that extends from one arm and attaches to the other. The strap can be stored in a pocket and then unfurled and removably connected to the other arm to hold the ends of the pillow together.

31 Claims, 5 Drawing Sheets

(56) References Cited

U.S. PATENT DOCUMENTS

| | | | |
|---|---|---|---|
| 2,795,802 | A | 6/1957 | Myers |
| 2,817,090 | A | 12/1957 | Toellner |
| 2,857,957 | A | 10/1958 | Gay |
| 2,880,424 | A | 4/1959 | Kalensky |
| D191,513 | S | 10/1961 | Kerr |
| 3,088,438 | A | 5/1963 | Oliphant |
| D201,492 | S | 6/1965 | Jacobson |
| 3,239,271 | A | 3/1966 | Bergersen |
| 3,298,035 | A | 1/1967 | Gobins |
| 3,327,330 | A | 6/1967 | McCullough |
| 3,392,737 | A | 7/1968 | Fefferman |
| 3,604,026 | A | 9/1971 | Scheips |
| 3,604,750 | A | 9/1971 | Doering |
| 3,671,977 | A | 6/1972 | Degnon |
| 3,713,692 | A | 1/1973 | McCracken et al. |
| D227,423 | S | 6/1973 | Ando |
| 3,773,287 | A | 11/1973 | Hechinger |
| D230,804 | S | 3/1974 | Lijewski |
| 3,840,916 | A | 10/1974 | Jennings |
| 3,848,281 | A | 11/1974 | Mathews |
| 3,899,210 | A | 8/1975 | Samhammer et al. |
| 3,899,797 | A | 8/1975 | Gunst |
| 3,911,512 | A | 10/1975 | Plate |
| D244,569 | S | 6/1977 | Laroye |
| 4,031,567 | A | 6/1977 | Planck |
| 4,037,764 | A | 7/1977 | Almosnino et al. |
| 4,050,737 | A | 9/1977 | Jordan |
| 4,173,048 | A | 11/1979 | Varaney |
| 4,194,254 | A | 3/1980 | Torrez |
| 4,197,604 | A | 4/1980 | Nakamura |
| 4,227,270 | A | 10/1980 | Rivera |
| 4,235,474 | A | 11/1980 | Rosenberg |
| 4,236,264 | A | 12/1980 | Britzman |
| D259,902 | S | 7/1981 | Rock |
| D265,027 | S | 6/1982 | Meyers |
| D266,800 | S | 11/1982 | Kula et al. |
| 4,383,713 | A | 5/1983 | Roston |
| 4,393,530 | A | 7/1983 | Stark |
| 4,428,514 | A | 1/1984 | Elf |
| 4,434,920 | A | 3/1984 | Moore |
| 4,506,396 | A | 3/1985 | Ritchie, Jr. et al. |
| 4,550,459 | A | 11/1985 | Endel et al. |
| 4,574,412 | A | 3/1986 | Smith |
| D284,220 | S | 6/1986 | Pote |
| 4,592,589 | A | 6/1986 | Hellwig |
| 4,606,078 | A | 8/1986 | Tkacsik |
| 4,606,087 | A | 8/1986 | Alivizatos |
| 4,624,021 | A | 11/1986 | Hofstetter |
| 4,654,907 | A | 4/1987 | Haugaard |
| 4,666,017 | A | 5/1987 | Zimmerman |
| 4,667,624 | A | 5/1987 | Smith |
| 4,670,923 | A | 6/1987 | Gabriel et al. |
| 4,676,198 | A | 6/1987 | Murray |
| 4,676,554 | A | 6/1987 | Harlick et al. |
| 4,685,163 | A | 8/1987 | Quillen et al. |
| 4,698,862 | A | 10/1987 | Mairs |
| 4,709,430 | A | 12/1987 | Nicoll |
| 4,712,258 | A | 12/1987 | Eves |
| 4,731,890 | A | 3/1988 | Roberts |
| 4,754,509 | A | 7/1988 | Pollard |
| 4,754,510 | A | 7/1988 | King |
| 4,757,925 | A | 7/1988 | Knittel |
| 4,763,369 | A | 8/1988 | Spector |
| 4,788,726 | A | 12/1988 | Rafalko |
| 4,790,035 | A | 12/1988 | Whyte |
| 4,794,657 | A | 1/1989 | Avery |
| 4,796,315 | A | 1/1989 | Crew |
| D299,988 | S | 2/1989 | Parabita |
| 4,827,542 | A | 5/1989 | Kurtenbach |
| 4,834,459 | A | 5/1989 | Leach |
| 4,836,605 | A | 6/1989 | Greenwood et al. |
| 4,840,144 | A | 6/1989 | Voorhees et al. |
| 4,850,144 | A | 7/1989 | Grisham et al. |
| 4,853,994 | A | 8/1989 | Ekstein |
| 4,861,109 | A | 8/1989 | Leach |
| D303,897 | S | 10/1989 | Phillips |
| 4,871,210 | A | 10/1989 | Alexander et al. |
| 4,901,384 | A | 2/1990 | Eary |
| D306,948 | S | 4/1990 | Zollinger |
| D308,788 | S | 6/1990 | Boehm |
| D309,018 | S | 7/1990 | Leach |
| D310,609 | S | 9/1990 | Burkhardt |
| D313,141 | S | 12/1990 | Witter et al. |
| 4,980,937 | A | 1/1991 | Mason et al. |
| 4,986,458 | A | 1/1991 | Linday |
| 4,996,734 | A | 3/1991 | Rowe |
| 4,999,863 | A | 3/1991 | Kane |
| 4,999,866 | A | 3/1991 | Lindsey |
| 5,026,315 | A | 6/1991 | Chap |
| D318,202 | S | 7/1991 | Weber |
| 5,035,013 | A | 7/1991 | Bloom |
| D318,969 | S | 8/1991 | Byrn |
| 5,048,136 | A | 9/1991 | Popitz |
| 5,088,141 | A | 2/1992 | Meyer et al. |
| 5,097,551 | A | 3/1992 | Smith |
| 5,103,514 | A | 4/1992 | Leach |
| 5,109,557 | A | 5/1992 | Koy et al. |
| 5,115,524 | A | 5/1992 | Antosko |
| 5,119,767 | A | 6/1992 | Jimenez |
| 5,154,649 | A | 10/1992 | Pender |
| 5,159,727 | A | 11/1992 | McCracken |
| 5,161,260 | A | 11/1992 | Reynolds |
| 5,165,130 | A | 11/1992 | Wendling |
| 5,178,309 | A | 1/1993 | Bicheler et al. |
| 5,179,741 | A | 1/1993 | Book |
| D332,865 | S | 2/1993 | Wilmink |
| 5,187,309 | A | 2/1993 | Esch et al. |
| 5,193,238 | A | 3/1993 | Clute |
| 5,216,772 | A | 6/1993 | Clute |
| D339,923 | S | 10/1993 | Clarke |
| 5,249,308 | A | 10/1993 | Blume |
| 5,261,134 | A | 11/1993 | Matthews |
| D342,615 | S | 12/1993 | Asher |
| 5,269,323 | A | 12/1993 | Krouskop |
| 5,272,780 | A | 12/1993 | Clute |
| 5,310,245 | A | 5/1994 | Lyszczasz |
| 5,325,818 | A | 7/1994 | Leach |
| 5,339,472 | A | 8/1994 | Yin |
| 5,341,531 | A | 8/1994 | Straub et al. |
| 5,363,524 | A | 11/1994 | Lang |
| 5,365,613 | A | 11/1994 | Henegan |
| 5,371,909 | A | 12/1994 | McCarty |
| D355,306 | S | 2/1995 | Moses |
| 5,439,008 | A | 8/1995 | Bowman |
| D365,241 | S | 12/1995 | Braden et al. |
| 5,473,785 | A | 12/1995 | Lager et al. |
| D366,368 | S | 1/1996 | McCarthy |
| 5,490,528 | A | 2/1996 | Day |
| D369,054 | S | 4/1996 | Straub et al. |
| D369,934 | S | 5/1996 | Straub et al. |
| 5,519,906 | A | 5/1996 | Fanto-Chan |
| D370,585 | S | 6/1996 | Faithfull |
| 5,522,528 | A | 6/1996 | Petricola |
| 5,546,620 | A | 8/1996 | Matthews |
| 5,551,109 | A | 9/1996 | Tingley et al. |
| D375,557 | S | 11/1996 | Dixon |
| 5,570,823 | A | 11/1996 | Lindy |
| 5,572,753 | A | 11/1996 | Ruscitto |
| 5,581,833 | A | 12/1996 | Zenoff |
| 5,586,351 | A | 12/1996 | Ive |
| D377,423 | S | 1/1997 | Latrella et al. |
| D377,881 | S | 2/1997 | Watt |
| 5,621,919 | A | 4/1997 | Graham |
| 5,647,076 | A | 7/1997 | Gearhart |
| D381,790 | S | 8/1997 | Harris et al. |
| D382,435 | S | 8/1997 | Schaffner et al. |
| 5,661,861 | A | 9/1997 | Matthews |
| 5,664,271 | A | 9/1997 | Bellavance |
| 5,685,016 | A | 11/1997 | Douglas |
| 5,699,569 | A | 12/1997 | Schwarz-Zohrer |
| D388,589 | S | 1/1998 | Walker |
| 5,708,982 | A | 1/1998 | Armani |
| 5,778,470 | A | 7/1998 | Haider |
| 5,813,066 | A | 9/1998 | Gebhard et al. |

(56) References Cited

U.S. PATENT DOCUMENTS

| | | | |
|---|---|---|---|
| 5,826,287 | A | 10/1998 | Tandrup |
| 5,857,598 | A | 1/1999 | Dunne |
| D408,676 | S | 4/1999 | Straub et al. |
| D409,038 | S | 5/1999 | Rojas, Jr. et al. |
| D412,234 | S | 7/1999 | Cox |
| 5,930,854 | A | 8/1999 | O'Neill et al. |
| D413,751 | S | 9/1999 | Alyea |
| 5,946,725 | A | 9/1999 | Shatzkin et al. |
| 5,950,887 | A | 9/1999 | Powell |
| D414,915 | S | 10/1999 | Anderson |
| D416,745 | S | 11/1999 | Noyes |
| 5,978,990 | A | 11/1999 | Akey |
| 5,979,981 | A | 11/1999 | Dunne et al. |
| 5,987,674 | A | 11/1999 | Schaffner et al. |
| D419,819 | S | 2/2000 | Bartoli |
| D420,845 | S | 2/2000 | Rumage |
| 6,026,525 | A | 2/2000 | Davis |
| 6,038,720 | A | 3/2000 | Matthews et al. |
| 6,049,929 | A | 4/2000 | Rawson |
| 6,052,848 | A | 4/2000 | Kelly |
| 6,055,687 | A | 5/2000 | Matthews |
| 6,061,854 | A | 5/2000 | Crowley |
| 6,065,655 | A | 5/2000 | Parewick |
| 6,079,067 | A | 6/2000 | Becker et al. |
| 6,088,854 | A | 7/2000 | Brownrigg |
| 6,112,960 | A | 9/2000 | Seering et al. |
| 6,119,873 | A | 9/2000 | Matthews |
| 6,123,389 | A | 9/2000 | O'Connor et al. |
| D431,745 | S | 10/2000 | Jackson |
| 6,141,805 | A | 11/2000 | Fisher-Cohen et al. |
| 6,205,600 | B1 | 3/2001 | Sedlack |
| 6,213,362 | B1 | 4/2001 | Lorenzini et al. |
| D443,461 | S | 6/2001 | Hall et al. |
| D444,981 | S | 7/2001 | Hall et al. |
| D445,506 | S | 7/2001 | Vinson et al. |
| D446,675 | S | 8/2001 | Straub |
| 6,279,185 | B1 | 8/2001 | Matthews |
| D447,376 | S | 9/2001 | Kramer |
| D450,517 | S | 11/2001 | Darling et al. |
| D453,653 | S | 2/2002 | Tunnell |
| 6,343,727 | B1 | 2/2002 | Leach |
| 6,349,437 | B1 | 2/2002 | Horning |
| 6,354,665 | B1 | 3/2002 | Ross |
| 6,408,463 | B1 | 6/2002 | Palacio |
| 6,412,128 | B1 | 7/2002 | Matthews |
| 6,427,251 | B1 | 8/2002 | Leach |
| 6,434,769 | B1 | 8/2002 | Koenig |
| 6,434,770 | B2 | 8/2002 | Matthews Brown |
| 6,453,493 | B1 | 9/2002 | Matthews Brown |
| 6,457,195 | B1 | 10/2002 | Holste |
| 6,463,608 | B1 | 10/2002 | Moe |
| 6,484,337 | B1 | 11/2002 | Moe et al. |
| D467,117 | S | 12/2002 | Guy |
| 6,499,164 | B1 | 12/2002 | Leach |
| 6,499,165 | B1 | 12/2002 | Morgillo |
| 6,505,366 | B1 | 1/2003 | Lied |
| 6,532,612 | B2 | 3/2003 | Matthews Brown |
| 6,539,567 | B1 | 4/2003 | Bae |
| 6,553,590 | B1 | 4/2003 | Leach |
| 6,574,810 | B2 | 6/2003 | Mangiaracina |
| 6,601,252 | B1 | 8/2003 | Leach |
| 6,625,828 | B2 | 9/2003 | Matthews Brown |
| 6,640,977 | B2 | 11/2003 | Matthews Brown et al. |
| 6,658,681 | B2 | 12/2003 | Britto et al. |
| 6,662,390 | B1 | 12/2003 | Berger |
| 6,671,907 | B1 | 1/2004 | Zuberi |
| 6,671,908 | B2 | 1/2004 | Brown et al. |
| 6,685,024 | B1 | 2/2004 | Matthews |
| 6,692,072 | B2 | 2/2004 | Nelson et al. |
| 6,708,354 | B1 | 3/2004 | Carter et al. |
| 6,711,770 | B1 | 3/2004 | Owens et al. |
| 6,751,817 | B1 | 6/2004 | Leach |
| D492,533 | S | 7/2004 | Cole |
| 6,760,934 | B1 | 7/2004 | Leach |
| 6,763,539 | B1 | 7/2004 | Bartley et al. |
| D493,964 | S | 8/2004 | Low |
| 6,802,092 | B1 | 10/2004 | Klein |
| 6,814,405 | B2 | 11/2004 | Norman |
| 6,851,143 | B2 | 2/2005 | Matthews Brown |
| 6,857,150 | B2 | 2/2005 | Matthews Brown et al. |
| D503,063 | S | 3/2005 | Bartle et al. |
| 6,874,183 | B1 | 4/2005 | Taylor |
| 6,892,406 | B2 | 5/2005 | Littlehorn |
| 6,905,169 | B1 | 6/2005 | Donoghue |
| 6,920,655 | B2 | 7/2005 | Mitchell |
| 6,944,898 | B2 | 9/2005 | Matthews Brown et al. |
| 7,000,273 | B2 | 2/2006 | Rivera-Wienhold et al. |
| 7,000,274 | B2 | 2/2006 | Matthews Brown et al. |
| 7,000,275 | B2 | 2/2006 | Matthews Brown et al. |
| 7,000,766 | B2 | 2/2006 | Matthews Brown et al. |
| 7,010,821 | B1 | 3/2006 | Leach |
| 7,017,212 | B2 | 3/2006 | Matthews Brown |
| D518,989 | S | 4/2006 | Clapp |
| 7,055,196 | B2 | 6/2006 | Littlehorn |
| 7,089,639 | B2 | 8/2006 | Matthews Brown et al. |
| 7,114,206 | B2 | 10/2006 | Leach |
| 7,127,760 | B2 | 10/2006 | Bartley et al. |
| 7,131,156 | B1 | 11/2006 | Walker-Craft |
| 7,146,663 | B2 | 12/2006 | Brown et al. |
| 2002/0029422 | A1 | 3/2002 | Matthews |
| 2004/0060116 | A1 | 4/2004 | Matthews-Brown |
| 2005/0210591 | A1 | 9/2005 | Mead et al. |
| 2006/0031992 | A1 | 2/2006 | Moore |
| 2007/0022526 | A1 | 2/2007 | Leach |
| 2007/0028384 | A1 | 2/2007 | Leach |
| 2007/0046084 | A1 | 3/2007 | Leach |
| 2007/0151031 | A1 | 7/2007 | Leach |

OTHER PUBLICATIONS

U.S. Appl. No. 11/324,387, filed Jan. 4, 2006, Leach.

U.S. Appl. No. 11/446,459, filed Jun. 5, 2006, Leach.

U.S. Appl. No. 11/511,160, filed Aug. 28, 2006, Leach.

The Two By You product, which is shown and described in the webpage attached as Exhibit A to this Statement, was in public use and/or on sale at least since prior to the filing date of this application, that is, prior to May 3, 2007.

The Cuddle-U product, which is shown and described in the webpage attached as Exhibit B to this Statement, was in public use and/or on sale at least since prior to the filing date of this application, that is, prior to May 3, 2007.

The Boppy pillow, which is shown and described in the webpage attached as Exhibit C to this Statement, was in public use and/or on sale at least since prior to the filing date of this application, that is, prior to May 3, 2007.

The Preggle product, which is shown and described in the webpage attached as Exhibit D to this Statement, was in public use and/or on sale at least since prior to the filed of this application, that is, prior to May 3, 2007.

The Hugster product, which is shown and described in the webpage attached as Exhibit E to this Statement, was in public use and/or on sale at least since prior to the filed of this application, that is, prior to May 3, 2007.

The Bosom Baby product, which is shown and described in the webpage attached as Exhibit F to this Statement, was in public use and/or on sale at least since prior to the filing date of this application, that is, prior to May 3, 2007.

INFANT SUPPORT PILLOW

FIELD OF THE INVENTION

The present invention relates to body or support pillows for infants.

BACKGROUND OF THE INVENTION

Infant support pillows have filled an important need for small infants and the parents caring for them. However, as in so many other ways, premature infants have special needs. Their tiny bodies may be too small to rest snugly in conventional infant support pillows. In addition, there may be no provision for multiple positions. Thus, there remains a need for an infant support pillow that accommodates smaller and premature infants as well as full term infants. In addition, there is a need for a versatile infant support pillow that provides a number of seating and support configurations. Still further, there is a need for an infant support pillow that accommodates the rapid growth of infants. These and other needs are met by the present invention.

DETAILED DESCRIPTION OF THE PREFERRED EMBODIMENTS

Figure 1:
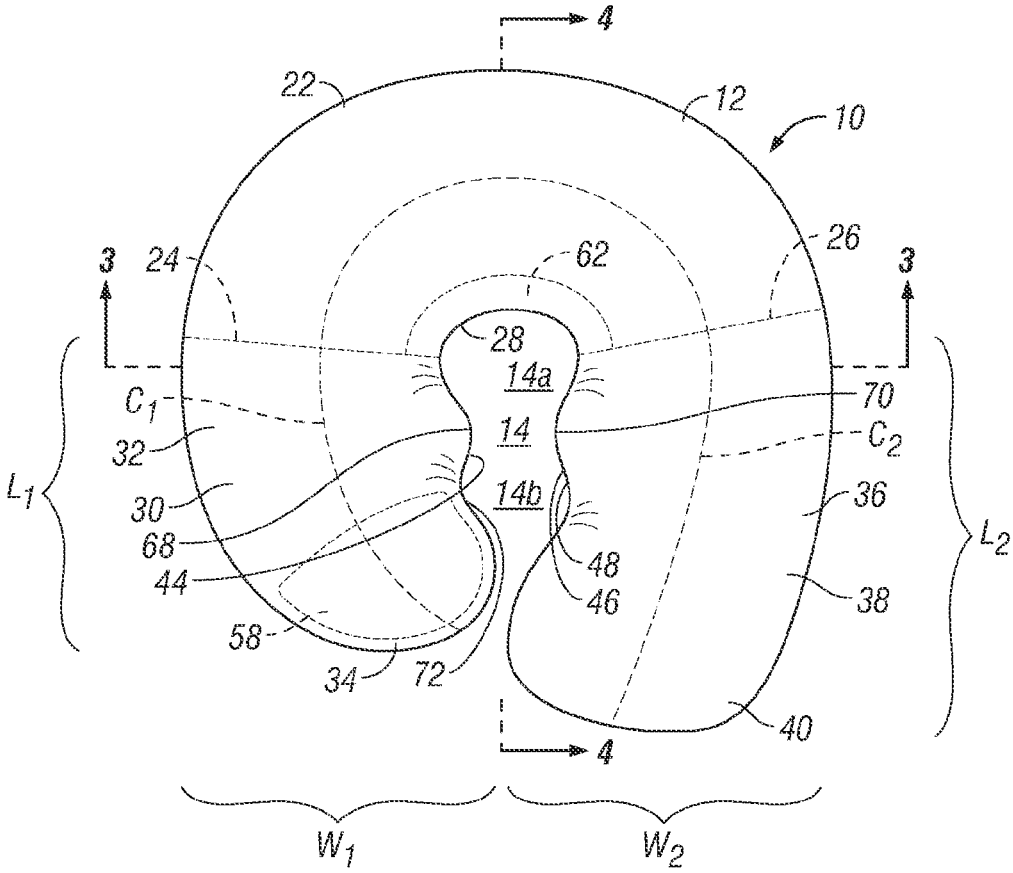
FIG. 1 is a plan view of an infant support pillow made in accordance with the present invention. The pillow, with its asymmetrical arms, is shown in its resting position.
Figure 2:
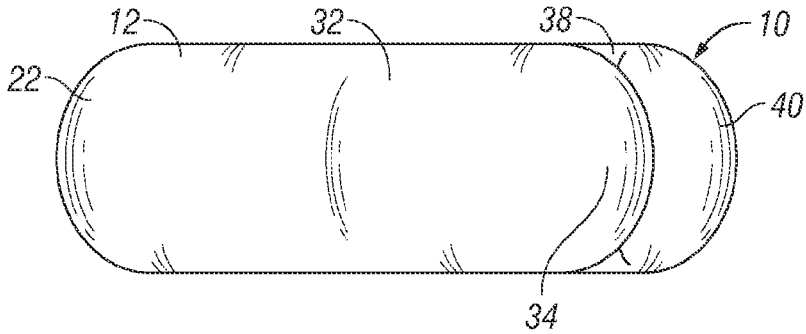
FIG. 2 is a side elevational view of left side of the pillow shown in FIG. 1.
Figure 3:
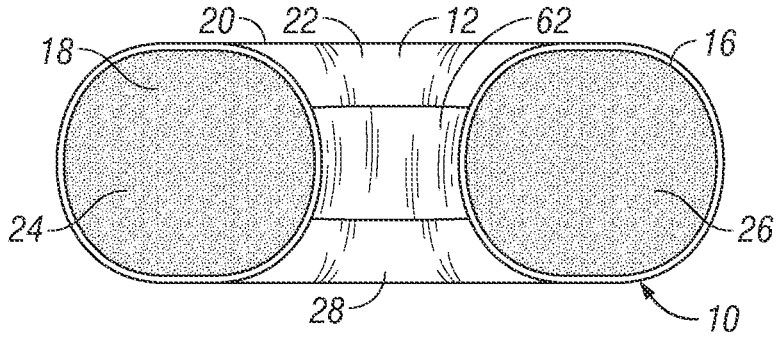
FIG. 3 is a cross-sectional view taken along the line 3-3 in FIG. 1.
Figure 4:
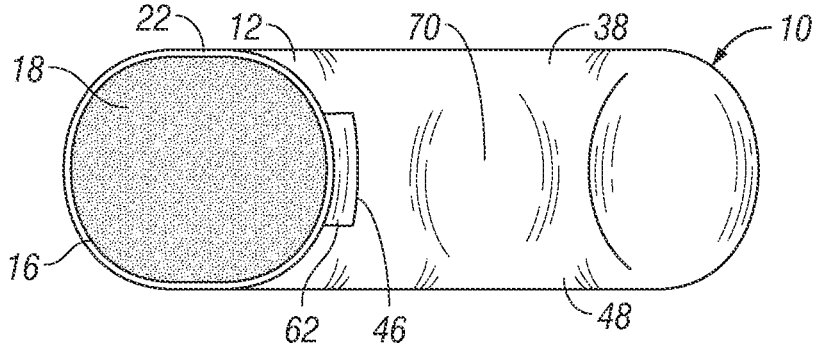
FIG. 4 is a cross-sectional view taken along the line 4-4 in FIG. 1.

Turning now to the drawings in general and to FIGS. 1-6 in particular, there is shown therein an infant support pillow made in accordance with a preferred embodiment of the present invention and designated generally by the reference numeral 10. The pillow 10 preferably is generally C-shaped having a continuous body 12 that forms a central 14 well sized to receive the infant (not shown in FIG. 1).

The pillow 10 preferably is formed by first sewing a fabric enclosure 16 (FIGS. 3 & 4) in the desired configuration. The enclosure material may be any suitable fabric, including but not limited to waterproof nylon, flannel, or elastic fabrics, such as spandex or cotton-spandex blends. However, presently a polyester/cotton blend is preferred. The enclosure 16 is filled with a compressible, resilient material 18. A preferred filler is polyester fiberfill. Other suitable fillers include down feathers, memory foam, polystyrene pellets. In some instances, an inflatable inner liner may be preferred. This construction provides a continuous compressible and resilient pillow body 12.

In most instances, a slip cover 20 is also included. The slip cover 20 is formed similar to the enclosure, but is designed for easy removal and cleaning. For example, the slip cover may be provided with a zipper, buttons, snaps, hook and loop connectors, or simply overlapping edges.

The pillow 10 comprises a center section 22 having a first end 24 and second end 26 (FIG. 1) and defining an inner perimeter 28 extending therebetween. Extending from the first end 24 of the center section 22 is the medial section 30 of a first arm 32 that terminates in a free end 34. While the shape of the free end 34 may vary, the preferred shape is symmetrical curve. The first arm 32 has a length $L_1$ and preferably is curved along its length.

Extending from the second end 26 of the center section 22 is the medial section 36 of a second arm 38 that terminates in a free end 40. In most instances, the second arm 38 also is curved along its length $L_2$. The free end 40 of the second arm 38 make take different shapes, but preferably is more blunted than the rounded end 34 of the first arm 32.

In the embodiment shown in FIG. 1, the length $L_2$ of the second arm 38 is greater than the length $L_1$ of the first arm 32, and the radius of curvature of the second arm, indicated at $C_2$, is also slightly greater than the radius of curvature of the first arm, indicated at $C_1$, thus providing asymmetric arms. Even more preferably, the width $W_1$ of the first arm 32 is greater than the width $W_2$ of the second arm 38.

Referring still to FIG. 1, the medial section 30 of the first arm 32 and the medial portion 36 of the second arm 38 each has an inner perimeter 44 and 46, respectively. The inner perimeters 44 and 46 are continuous with the inner perimeter 28 of the center section 22, together forming the central well 14.

In addition, in this embodiment, the second arm 38 defines a recess 48 shaped and positioned to receive the free end 34 of the first arm 32. In this way, when the pillow 10 is in its resting position, as shown in FIG. 1, the free end 34 of the first arm 32 is adjacent to the recess 48. However, with only slight pressure, the free end 34 of the first arm 32 can be tucked into in the recess 48, thereby totally enclosing the well 14, as shown in FIG. 5.

Most preferably, the recess 48 is a rounded, inward (relative to the central well 14) curve, and it is most advantageously positioned in the inner perimeter 46 of the medial portion 36 second arm 38 adjacent the free end 40. However, other configurations are possible.

Figure 5:
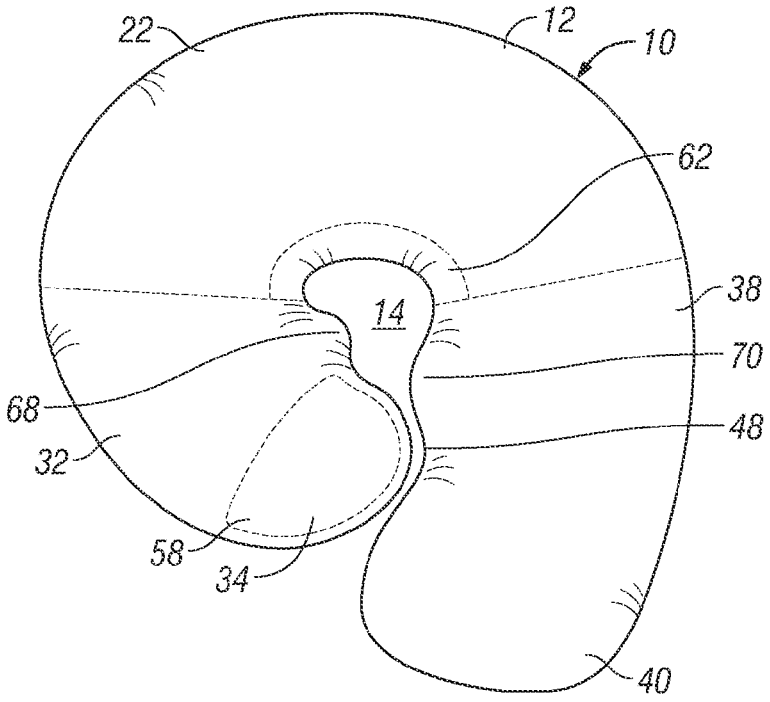
FIG. 5 is a plan view of the pillow of FIG. 1 shown compressed into a closed position.

Now it will be understood that the first and second arms 32 and 38 are positionable in an open position, as shown in FIG. 1, and a closed position, as shown in FIG. 5. In the open position, the free end 34 of the first arm 32 is adjacent to but not received in the recess 48 of the second arm 38. In the closed position, the free end 34 is received in the recess 48. In the embodiment illustrated in FIGS. 1-5, when the pillow 10 is in the resting position (FIG. 1), the arms 32 and 38 are in the open position. As used herein, "resting position" refers to the position and shape the pillow body naturally assumes when no tension or pressure is exerted on any part it.

Even more preferably, the complementary shapes of the recess 48 and the free end 34 of the first arm 32 preferably are such, when combined with the resilience of the pillow body 12, that the pillow 10 will maintain the arms 32 and 38 in the closed position until some movement or repositioning occurs.

Even more preferably, the pillow 10 comprises a strap 56 for holding the first and second arms 32 and 38 in the closed position.

One suitable connecting strap arrangement is shown in U.S. patent Ser. No. 11/511,160, entitled "Apparatus and Method for Question Mark-Shaped Body Pillow and Support System," and filed on Aug. 28, 2006, which is incorporated herein by reference. In the event there is an inconsistency between the disclosure of the prior application and the present disclosure, the present disclosure controls.

Briefly, the strap 56 is attached, usually permanently, to either of the first and second arms 32 and 38, but ideally is fixed to the free end 34 of the first arm 32. The slip cover 20 may be provided with a sewn-in pouch or pocket 58 for holding the strap 56 in a stored or retracted position (FIG. 1). The strap 56, which ideally is made of flexible fabric matching the cover 20, is long enough when unfurled to reach over and around the medial section 36 of the second arm 38. The free end of the strap 56 is connectable to the outside edge or back of the second arm 38 by some form of releasable, reusable connection, such as a ties, button, snap, or hook and loop fastener (not shown). Thus, the strap 56 is movable between a retracted or stored position, preferably in the pocket 58, to a deployed position, in which the free end 34 of the first arm 32 is secured in the recess 48 of the second arm 38 to hold the first and second arms in the closed position.

Referring still to FIGS. 1-6, the inner perimeter 28 of the center section 22 comprises an elastic panel of strip 62 that extends from about the first end 24 to the second end 26. This elastic strip may be formed in several ways. For example, a separate panel of the material from which the slip cover 20 is made may be sewn into the inner seam of the cover. Alternately, a band of elastic may be either sewn inside the inner perimeter of the enclosure 16 or the slip cover 20, or substituted for a strip of the fabric of the either the enclosure or the cover.

Most preferably, the elastic strip 62 will be inserted so that when the pillow 10 is in a resting position, the elastic strip is at least slightly tensioned. In this way, the center section 22 will gently hug or embrace the infant's body even when the pillow 10 is in the resting position and will also resist spreading of the arms 32 and 38 when the infant is placed in the well 14 of the pillow.

With continuing reference to FIGS. 1-6, the shape of the central well 14 may be adapted especially for small or premature infants, or those infants with coordination or motor disabilities. As best seen in FIG. 1, a first bulge 68 is formed on the inner perimeter 46 of the medial section 30 of the first arm 32 and spaced a distance from the free end. Also, a second bulge 70 is formed on the inner perimeter 48 of the medial section 36 of the second arm 38. The bulges 68 and 70 curve outwardly (relative to the central well 14) and oppose each other thereby dividing the central well 14 into a primary well 14*a* and a secondary well 14*b*. More specifically, the primary well 14*a* is formed between the bulges 68 and 70 and the center section 22, and the secondary well 14*b* is formed between the bulges 68 and 70 and the free ends 34 and 40.

The bulges 68 and 70 may be shaped and positioned so that the primary well 14*a* is larger than the secondary well 14*b*. In addition, the second bulge 70 in the second arm 38 is positioned so that the recess 48 is between the bulge 70 and free end 40. Even more advantageously, a recess 72 also is formed in the inner perimeter 46 of the first arm 32 between the bulge 68 and the free end 34, so that the second well 14*b* is defined by the recesses 48 and 72.

Figure 6:
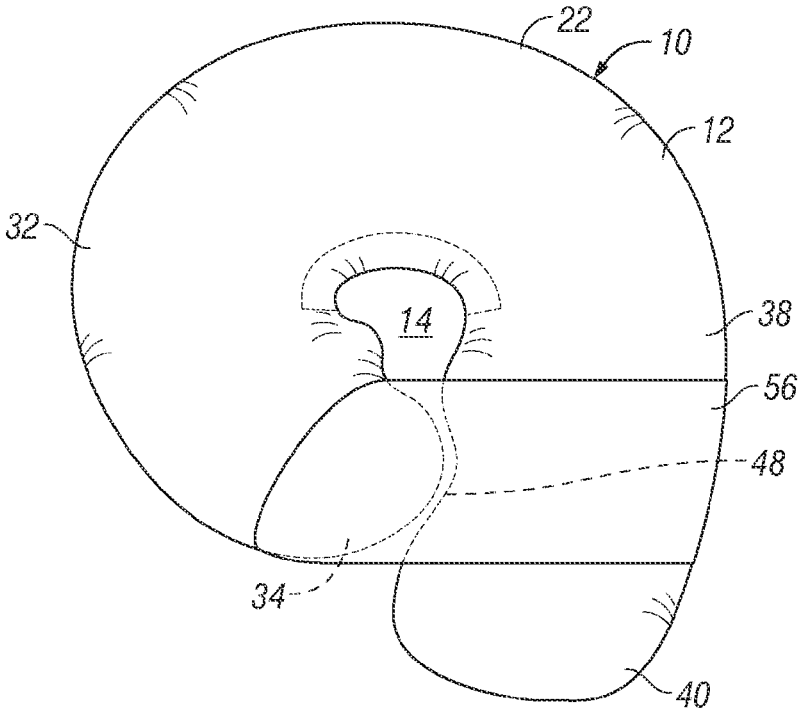
FIG. 6 is a plan view of the pillow of FIG. 2 shown in the compressed position with the strap in place to hold the pillow arms in the closed position.
Figure 7:
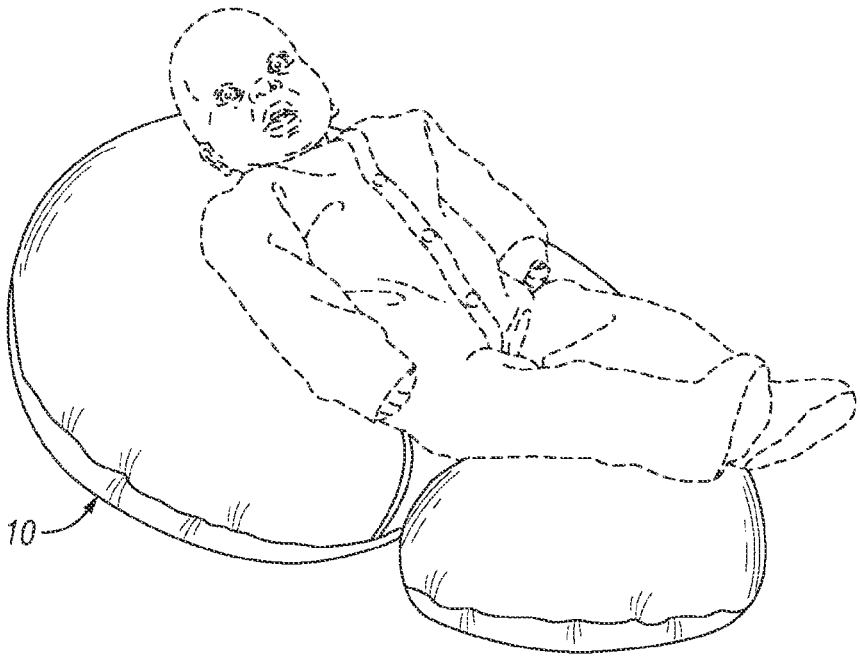
FIG. 7 is perspective view of the pillow supporting an infant with his legs placed over the longer arm of the pillow.
Figure 8:
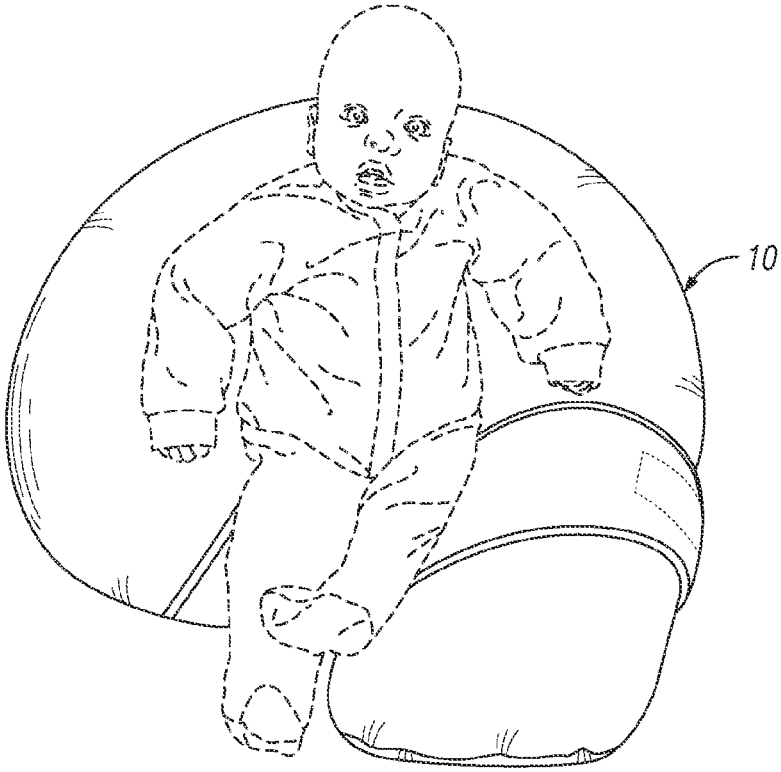
FIG. 8 is a perspective view of the pillow supporting an infant with his legs placed over the strap of the pillow.

FIGS. 7 and 8 illustrate use of the pillow 10. In both FIGS. 7 and 8, the strap 56 is secured in the deployed position so that the free end 34 of the first arm 32 is tucked well into the recess 48 on the second arm 38. It will now be seen that compression of the arms 32 and 38 towards each other "bunches up" or increases the thickness of the center section 22, allowing a higher backrest for the infant. FIGS. 7 and 8 also illustrate the versatility of the pillow 10; in FIG. 7, the infant's legs extend over the longer second arm 38, while in FIG. 8, the infant's legs extend over the strap 56 where the free ends 34 and 40 meet. As best seen in FIG. 6, the strap forms a support surface overlying where free end 34 of the first arm 32 is received in the recess 48 on the second arm 38, this support surface being continuous with the first and second arms. As shown, the section of the strap 56 forming the support surface has a width about the same as the width of one or both of the arms.

Figure 9:
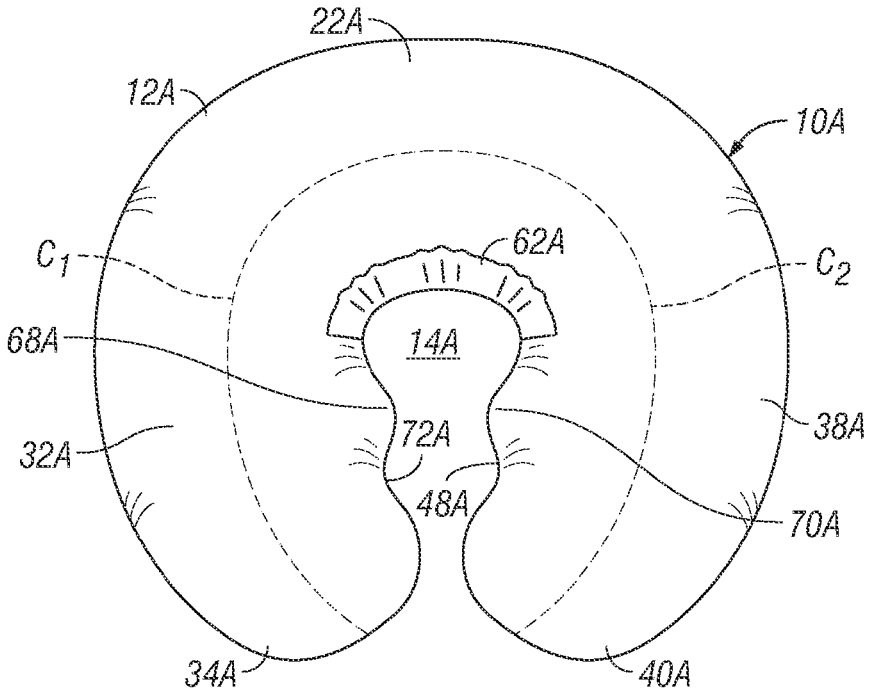
FIG. 9 is a plan view of a second embodiment of the infant support pillow of the present invention with symmetrical arms.

Turning now to FIG. 9, another embodiment of the infant support pillow will be described. In this embodiment, designated by the reference numeral 10A, the first and second arms 32A and 38A are symmetrical having about the same radius of curvature $C_1$ and $C_2$ providing a so-called ambidextrous version of the dual-welled pillow. The strap 56 and pocket 58 found in the first embodiment have been eliminated here. The elastic strip 62A is remains, and the opposing bulges 68A and 70A are included to create the two-chambered well 14A.

In this embodiment, because the arms 32A and 38A are the same length, the end 34A, 40A of each arm 32A, 38A can be tucked into the recess on the other arm. That is, the recess 48A in the second arm 38A is shaped to receive the free end 34A of the first arm 32A, and the recess 72A in the first arm 32A is shaped to receive the free end 40A of the second arm 38A. Thus, the first and second arms 32A and 38A are positionable in either an open position or a closed position. In the open or resting position, the free ends 34A and 40A of the first and second arms 32A and 38A rest adjacent to each other. In the closed position, the free end of one arm is received in the recess of the other arm.

Figure 10:
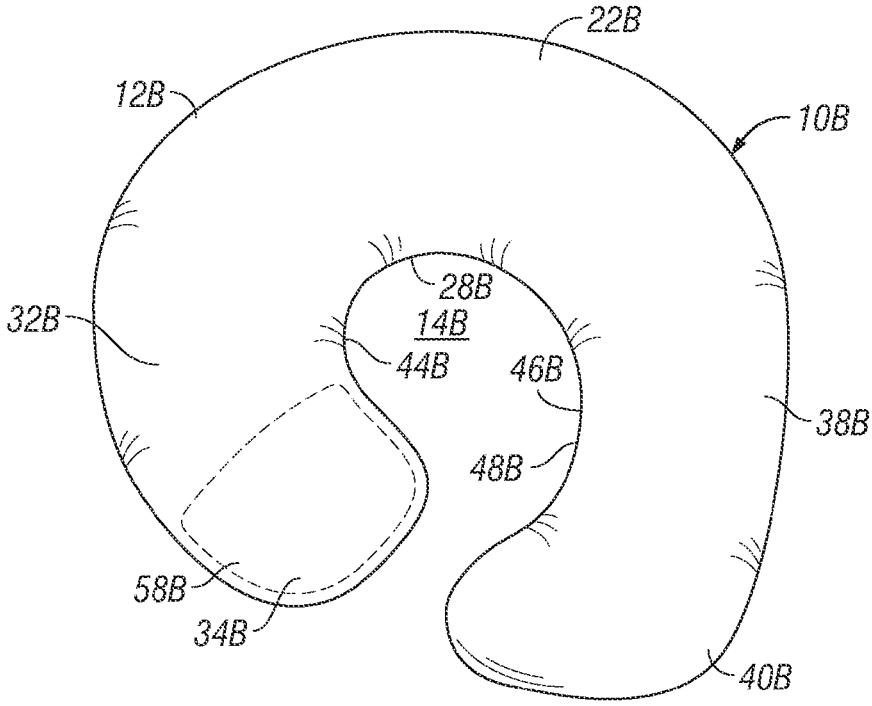
FIG. 10 is a plan view of a third embodiment of the infant support pillow of the present invention with asymmetrical arms without the opposing bulges in the central well.

In FIG. 10, a third embodiment designated as 10B is shown. In the pillow 10B, the arms 32B and 38B are asymmetrical and similar in shape to the arms 32 and 38 in FIG. 1. However, in this embodiment, the bulges and the elastic strip have been omitted, leaving only single well 14B. There is a recess 48B in the inner periphery 46B on the second arm 38B, but no corresponding recess in the inner recess 44B on the first arm 32B. The pocket 58B is shown on the first arm 32B in this embodiment, as in the previous embodiment in FIGS. 1-6. However, the placement of the pocket and strap can vary.

It will now be apparent that the shape of the central well of the infant support pillow of this invention is defined by the contours of the inner perimeter of the pillow body. In the preferred embodiment the well is generally oval or circular. Or, in the case of the primary and secondary wells, each of the wells is generally oval or circular. However, the present invention is not so limited. Other shapes may be employed.

Similarly, in the preferred embodiments shown and described herein, the outer perimeter of the pillow is curved. However, the outer edge may take other shapes. For example, the outer periphery could be angular, such as square or polygonal, or it could be scalloped, without affecting the intended function of the pillow.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A pillow for supporting an infant, the pillow comprising:

a center section having a first end, a second end, and an inner perimeter extending therebetween;

a first arm having a length and a width and comprising a medial portion extending from the first end of the center section and terminating in a free end; and a second arm comprising a medial portion extending from the second end of the center section and terminating in a free end, wherein the second arm has a width and a length, wherein the length of the second arm is greater than the length of the first arm, and wherein the second arm defines a recess shaped to receive the free end of the first arm;

wherein the medial portion of each of the first and second arms has an inner perimeter continuous with the inner perimeter of the center section together forming a central well sized to receive the infant;

wherein the center section, first arm, and second arm comprise compressible, resilient material forming a continuous pillow body;

wherein the first and second arms are positionable in an open position, in which the free end of the first arm is not received in the recess of the second arm, and in a closed position, in which the free end of the first arm is received in the recess of the second arm; and a strap extending between the first and second arms and being removably connectable to at least one of the first and second arms, wherein the strap is movable between a stored position and a deployed position, wherein in the deployed position the strap extends over the recess in the inner perimeter of the medial portion of the second arm thereby forming a support surface overlying where the free end of the first arm is received in the recess of the second arm, wherein the support surface of the strap has a width about the same as the width of one of the first and second arms, wherein the support surface is continuous with the first and second arms and releasably secures the first and second arms in the closed position.

2. The pillow of claim 1 wherein, when the pillow is in a resting position, the first and second arms are in the open position.

3. The pillow of claim 1 wherein the pillow body comprises a fabric enclosure filled with a compressible, resilient filling.

4. The pillow of claim 3 wherein the pillow further comprises a removable cover.

5. The pillow of claim 4 wherein the strap forms part of the cover from the free end of one of the first and second arms.

6. The pillow of claim 5 wherein the cover further comprises a pocket configured to enclose the strap when the strap is in the stored position.

7. The pillow of claim 1 wherein the recess in the second arm is formed in the inner perimeter of the medial portion.

8. The pillow of claim 7 wherein the free end of the first arm is a rounded curve and the recess in the second arm is an inward curve in the inner perimeter adjacent the free end of the second arm.

9. The pillow of claim 8 wherein the strap extends from the free end of the first arm and is removably connectable to the second arm.

10. The pillow of claim 1 wherein the inner perimeter of the center section comprises an elastic strip that extends from about the first end of the center section to about the second end of the center section.

11. The pillow of claim 1 wherein the inner perimeter of the first arm comprises a first bulge and the inner perimeter of the second arm comprises a second bulge, the first and second bulges opposing each other across the central well forming a primary well and a secondary well.

12. The pillow of claim 11 wherein the primary well is larger than the secondary well.

13. The pillow of claim 12 wherein the recess in the second arm is positioned between the second bulge and the free end of the second arm.

14. The pillow of claim 13 wherein the strap extends from the free end of the first arm and is removably connectable to the second arm.

15. The pillow of claim 11 wherein the inner perimeter of the center section comprises an elastic strip that extends from about the first end of the center section to about the second end of the center section and between the first and second bulges.

16. The pillow of claim 15 wherein the strap extends from the free end of the first arm and is removably connectable to the second arm.

17. The pillow of claim 1 wherein the strap extends from the free end of the first arm and is removably connectable to the medial portion of the second arm.

18. The pillow of claim 17 wherein the inner perimeter of the center section comprises an elastic strip that extends from about the first end of the center section to about the second end of the center section.

19. The pillow of claim 1 wherein the center section of the pillow body is generally curved in configuration.

20. The pillow of claim 1 wherein the center section and first and second arms of the pillow body all are generally curved in configuration forming a C-shaped pillow body.

21. The pillow of claim 1 wherein the continuous inner perimeters of the center section and first and second arms of the pillow body all are generally curved in configuration forming a generally circular or oval central well.

22. A pillow for supporting an infant, the pillow comprising:

a center section having a first end, a second end, and an inner perimeter extending therebetween;

a first arm having a width and comprising a medial portion extending from the first end of the center section and terminating in a free end; and a second arm having a width comprising a medial portion extending from the second end of the center section and terminating in a free end;

wherein the medial portion of each of the first and second arms has an inner perimeter continuous with the inner perimeter of the center section;

wherein the inner perimeter of the first arm defines a first bulge spaced a distance from the free end and a first recess between the first bulge and the free end;

wherein the inner perimeter of the second arm defines a second bulge spaced a distance from the free end and a second recess between the second bulge and the free end of the second arm;

wherein the first and second arms are configured relative to the center section so that the first and second bulges oppose each other forming a primary well between the bulges and the center section, and so that the first and second recesses oppose each other forming a secondary well between the first and second bulges and free ends of the first and second arms;

wherein the first and second arms are positionable in an open position and a closed position, wherein in the closed position the free end of the first arm is received in the recess of the second arm;

a strap that extends from one of the first and second arms, wherein the strap is movable between a stored position and a deployed position wherein in the deployed position the strap extends from the free end of first arm to the second arm and is removably connectable to the medial portion of the second arm so as to form a support surface overlying where the free end of the first arm is received in the recess of the second arm, wherein the support surface of the strap has a width about the same as the width of one of the first and second arms, wherein the support surface is continuous with the first and second arms and secures the first and second arms in the closed position; and wherein the center section, first arm, and second arm comprise compressible, resilient material forming a continuous pillow body.

23. The pillow of claim 22 wherein the first recess in the first arm is shaped to receive the free end of the second arm, and wherein the second recess of the second arm is shaped to receive the free end of the first arm, whereby the first and second arms are positionable in either an open position, in which neither of the free ends of the first and second arms is received in either of the first and second recess of the first and second arms, or a closed position, in which either the free end of the first arm is received in the second recess of the second arm or the free end of the second arm is received in the first recess of the first arm.

24. The pillow of claim 23 wherein, when the pillow is in a resting position, the first and second arms are in the open position.

25. The pillow of claim 24 wherein the inner perimeter of the center section comprises an elastic strip that extends from about the first end of the center section to about the second end of the center section.

26. The pillow of claim 22 wherein the pillow body comprises a fabric enclosure filled with a compressible, resilient filling.

27. The pillow of claim 26 wherein the pillow further comprises a removable cover.

28. The pillow of claim 22 wherein the primary well is larger than the secondary well.

29. The pillow of claim 22 wherein the first and second arms are about equal in length.

30. The pillow of claim 22 wherein the inner perimeter of the center section comprises an elastic strip that extends from about the first end of the center section to about the second end of the center section.

31. The pillow of claim 22 wherein the strap extends from the first arm and is removably connectable to the second arm.

* * * * *

UNITED STATES PATENT AND TRADEMARK OFFICE

CERTIFICATE OF CORRECTION

PATENT NO. : 8,661,587 B1
APPLICATION NO. : 11/743729
DATED : March 4, 2014
INVENTOR(S) : Jamie S. Leach It is certified that error appears in the above-identified patent and that said Letters Patent is hereby corrected as shown below:

In the Specifications

Column 1, line 29: replace “of left” with --of the left--.
Column 1, line 40: replace “is perspective” with --is a perspective--.
Column 1, line 59: replace “central 14 well” with --central well 14--.

Column 2, line 2: replace “foam, polystyrene” with --foam, and polystyrene--.
Column 2, line 16: replace “is symmetri-” with --is a symmetri- --.
Column 2, line 24: replace “make” with --may--.
Column 2, line 44: replace “into in” with --into--.
Column 2, line 50: replace “36 second” with --36 of the second--.
Column 2, line 62: replace “part it” with --part of it--.

Column 3, line 21: replace “ties” with --tie--.
Column 3, line 35: replace “of the either” with --of either--.

Column 4, line 22: replace “is remains” with --remains--.
Column 4, line 49: replace “embodiment the” with --embodiment, the--.

Column 5, line 1-2: replace “inventions” with --invention--.

Signed and Sealed this
Seventeenth Day of June, 2014

Michelle K. Lee

Michelle K. Lee
*Deputy Director of the United States Patent and Trademark Office*